US010347273B2

(12) United States Patent
Komeiji et al.

(10) Patent No.: US 10,347,273 B2
(45) Date of Patent: Jul. 9, 2019

(54) SPEECH PROCESSING APPARATUS, SPEECH PROCESSING METHOD, AND RECORDING MEDIUM

(71) Applicant: NEC Corporation, Minato-ku, Tokyo (JP)

(72) Inventors: Shuji Komeiji, Tokyo (JP); Masanori Tsujikawa, Tokyo (JP); Ryosuke Isotani, Tokyo (JP)

(73) Assignee: NEC CORPORATION, Tokyo (JP)

( * ) Notice: Subject to any disclaimer, the term of this patent is extended or adjusted under 35 U.S.C. 154(b) by 0 days.

(21) Appl. No.: 15/528,848

(22) PCT Filed: Dec. 8, 2015

(86) PCT No.: PCT/JP2015/006120
§ 371 (c)(1),
(2) Date: May 23, 2017

(87) PCT Pub. No.: WO2016/092837
PCT Pub. Date: Jun. 16, 2016

(65) Prior Publication Data

US 2017/0337935 A1 Nov. 23, 2017

(30) Foreign Application Priority Data

Dec. 10, 2014 (JP) ..... 2014-249982

(51) Int. Cl.
*G10L 21/0232* (2013.01)
*G10L 25/21* (2013.01)

(52) U.S. Cl.
CPC ..... *G10L 21/0232* (2013.01); *G10L 25/21* (2013.01)

(58) Field of Classification Search
None
See application file for complete search history.

(56) References Cited

U.S. PATENT DOCUMENTS

2003/0004715 A1* 1/2003 Grover ..... G10L 21/0208 704/233
2005/0175129 A1* 8/2005 Roovers ..... H04M 9/082 375/350

(Continued)

FOREIGN PATENT DOCUMENTS

JP 2008-216721 A 9/2008
JP 4765461 B2 6/2011

(Continued)

OTHER PUBLICATIONS

JP 2013-167698 (A) Machine Translation, 20120214 , Nakatani tomohiro, 62 pages.*

(Continued)

*Primary Examiner* — Thuykhanh Le

(57) ABSTRACT

A speech processing apparatus includes: an expectation value calculation unit configured to calculate, using an input signal spectrum and a speech model that models a feature quantity of speech, a spectrum expectation value which is an expectation value of a spectrum of an acoustic component included in the input signal spectrum; and an acoustic power estimation unit configured to estimate an acoustic power of the acoustic component of the input signal spectrum based on the input signal spectrum and the spectrum expectation value.

6 Claims, 5 Drawing Sheets

(56) References Cited

U.S. PATENT DOCUMENTS

2005/0219068 A1* 10/2005 Jones ..... G01S 5/30 341/50
2007/0027685 A1* 2/2007 Arakawa ..... G10L 21/0208 704/226
2009/0070117 A1* 3/2009 Endo ..... G10L 19/005 704/265
2009/0254342 A1* 10/2009 Buck ..... G10L 15/222 704/233
2011/0082692 A1* 4/2011 Lim ..... G10L 21/0208 704/225
2011/0099010 A1* 4/2011 Zhang ..... G10L 21/0272 704/233
2011/0288858 A1* 11/2011 Gay ..... G10L 21/028 704/226
2012/0095755 A1* 4/2012 Otani ..... G10L 21/0208 704/205
2012/0209611 A1* 8/2012 Furuta ..... G10L 21/038 704/268
2012/0253813 A1* 10/2012 Katagiri ..... G10L 25/78 704/254
2013/0006645 A1* 1/2013 Jiang ..... H03M 7/3082 704/500
2013/0054231 A1* 2/2013 Jeub ..... H04R 3/005 704/226
2013/0246056 A1* 9/2013 Sugiyama ..... G10L 21/02 704/205
2013/0246060 A1* 9/2013 Sugiyama ..... G10L 21/0208 704/226
2013/0332157 A1* 12/2013 Iyengar ..... G10L 15/20 704/233
2014/0177868 A1* 6/2014 Jensen ..... H04R 3/002 381/94.7
2014/0316775 A1* 10/2014 Furuta ..... G10L 21/0208 704/226
2014/0358552 A1* 12/2014 Xu ..... G10L 25/78 704/275
2015/0032445 A1* 1/2015 Souden ..... G10L 21/0264 704/208
2015/0039305 A1* 2/2015 Huang ..... G10L 15/20 704/233
2015/0058002 A1* 2/2015 Yermeche ..... G10L 25/84 704/233
2015/0287406 A1* 10/2015 Kristjansson ..... G10L 15/20 704/233
2015/0348530 A1* 12/2015 Findlay ..... H04S 7/304 381/309
2016/0232920 A1* 8/2016 Matheja ..... H04R 3/005
2016/0379662 A1* 12/2016 Chen ..... G10L 21/0232 704/233

FOREIGN PATENT DOCUMENTS

JP 2013-167698 A 8/2013
JP 2014-021307 A 2/2014
WO 2013/118192 A1 8/2013

OTHER PUBLICATIONS

Pedro J. Moreno et al., "A Vector Taylor Series Approach for Environment Independent Speech Recognition," Proc. ICASSP1996, pp. 733-736 vol. 2, 1996.
M. Tsujikawa et al., "In-car speech recognition using model-based wiener filter and multi-condition training," Interspeech 2008, pp. 972-975, Sep. 22-26, 2008, Brisbane, Australia.
International Search Report for PCT Application No. PCT/JP2015/006120, dated Feb. 9, 2016.
English translation of Written opinion for PCT Application No. PCT/JP2015/006120.

* cited by examiner

SPEECH PROCESSING APPARATUS, SPEECH PROCESSING METHOD, AND RECORDING MEDIUM

This application is a National Stage Entry of PCT/JP2015/006120 filed on Dec. 8, 2015, which claims priority from Japanese Patent Application 2014-249982 filed on Dec. 10, 2014, the contents of all of which are incorporated herein by reference, in their entirety.

TECHNICAL FIELD

The present invention relates to a speech processing apparatus, a noise suppression apparatus, a speech processing method, and a recording medium.

BACKGROUND ART

Model-based noise suppression techniques for suppressing noise using a speech model which models the features of speech have been developed. A model-based noise suppression method is a method for suppressing noise with high accuracy by referring to speech information of a speech model and is disclosed, for example, in Patent Literature 1, Non-Patent Literature 1, and Non-Patent Literature 2.

For example, Patent Literature 1 discloses a noise suppression system which uses a speech model. The noise suppression system disclosed in Patent Literature 1 obtains temporarily estimated speech in a spectrum region from an input signal and an average spectrum of noise and corrects the temporarily estimated speech using a standard pattern. The noise suppression system calculates a noise reduction filter from the corrected temporarily estimated speech and the average noise spectrum and calculates estimated speech from the noise reduction filter and an input signal spectrum.

CITATION LIST

Patent Literature

PTL 1: Japanese Patent No. 4765461

Non Patent Literature

NPL 1: Pedro J. Moreno, Bhiksha Raj and Richard M. Stern, "A Vector Taylor Series Approach for Environment Independent Speech Recognition," Proc. ICASSP1996, pp. 733-736 vol. 2, 1996.

NPL 2: M. Tsujikawa, T. Arakawa, and R. Isotani, "In-car speech recognition using model-based wiener filter and multi-condition training," INTERSPEECH 2008, pp. 972-975, 2008. 09.

SUMMARY OF INVENTION

Technical Problem

The model-based noise suppression method disclosed in Non-Patent Literature 1 cannot suppress noise correctly when there is a mismatch between acoustic power of the input signal and acoustic power information of the speech model. Due to this, the technique of Non-Patent Literature 1 is not robust to variation in the acoustic power of the input signal.

On the other hand, a model-based noise suppression method disclosed in Patent Literature 1 and Non-Patent Literature 2 estimates acoustic power from an input signal.

Therefore, the model-based noise suppression method disclosed in Patent Literature 1 and Non-Patent Literature 2 is robust to a mismatch between the power of the input signal and the power information of the speech model.

Acoustic power γ estimated from the input signal is represented by Equation (1).

[Math. 1]

$$\gamma = \sum_{k=0}^{K-1} S_{in}(k) \tag{1}$$

Here, $S_{in}(k)$ (k=0, . . . , K−1, where k is a frequency bin and K is the Nyquist frequency) is the spectrum of the input signal.

However, in acoustic power estimation which uses Equation (1), it is not possible to estimate the acoustic power included in the input signal correctly when the input signal includes noise or the noise is suppressed.

The present invention has been made in view of the above-described issues, and an object thereof is to provide a technique of estimating the acoustic power included in an input signal with high accuracy.

Solution to Problem

A speech processing apparatus according to one aspect of the present invention includes: expectation value calculation means for calculating, using an input signal spectrum and a speech model that models a feature quantity of speech, a spectrum expectation value which is an expectation value of a spectrum of an acoustic component included in the input signal spectrum; and acoustic power estimation means for estimating an acoustic power of the acoustic component of the input signal spectrum based on the input signal spectrum and the spectrum expectation value.

A noise suppression apparatus according to one aspect of the present invention includes: noise estimation means for calculating estimated noise from an input signal; a speech processing apparatus that estimates an expectation value of a spectrum of an acoustic component included in a spectrum of the input signal and an acoustic power of the acoustic component from the spectrum of the input signal; suppression gain calculation means for calculating a suppression gain using the expectation value of the spectrum of the acoustic component, the acoustic power, and the spectrum of the estimated noise; and noise suppression means for suppressing noise in the input signal using the suppression gain and the spectrum of the input signal, wherein the speech processing apparatus includes: expectation value calculation means for calculating, using the spectrum of the input signal and a speech model that models a feature quantity of speech, an expectation value of the spectrum of the acoustic component; and acoustic power estimation means for estimating the acoustic power based on the spectrum of the input signal and the expectation value of the spectrum of the acoustic component.

A speech processing method according to one aspect of the present invention includes: calculating a spectrum expectation value which is an expectation value of a spectrum of an acoustic component included in an input signal spectrum using the input signal spectrum and a speech model that models a feature quantity of speech; and estimating an acoustic power of the acoustic component of the input signal spectrum based on the input signal spectrum and the spectrum expectation value.

A computer program for realizing the above-described apparatuses or method by a computer and a computer-readable recording medium storing the computer program are also included in the scope of the present invention.

Advantageous Effects of Invention

According to the present invention, it is possible to estimate the acoustic power included in an input signal with high accuracy.

EXAMPLE EMBODIMENT

<First Example Embodiment>

Hereinafter, a first example embodiment of the present invention will be described with reference to the drawings.

(Configuration of Speech Processing Apparatus 10)

Figure 1:
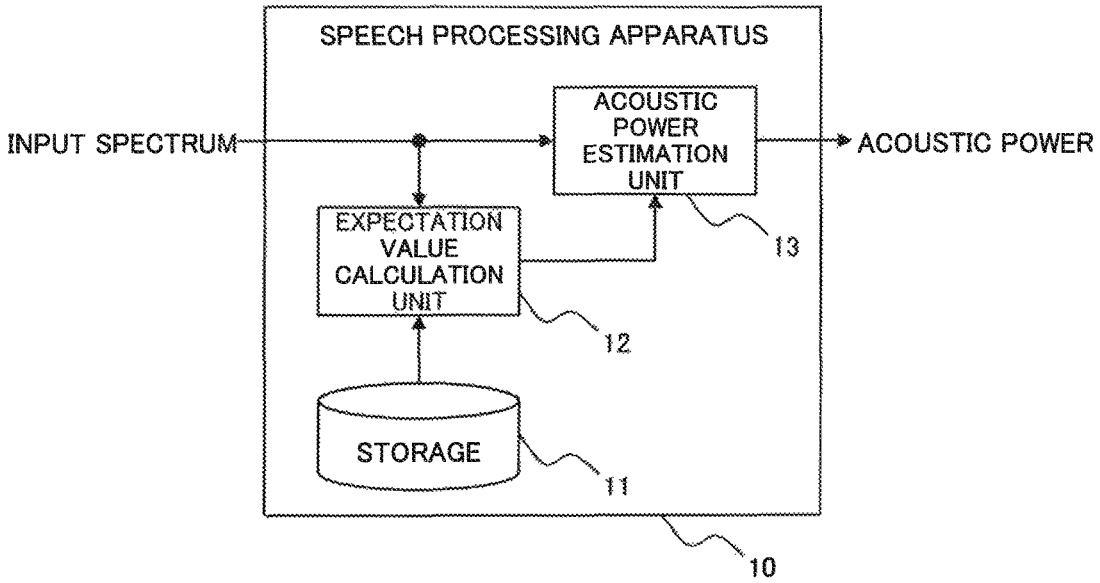
FIG. 1 is a functional block diagram illustrating an example of a functional configuration of a speech processing apparatus according to a first example embodiment of the present invention.

FIG. 1 is a functional block diagram illustrating an example of a functional configuration of a speech processing apparatus according to a first example embodiment of the present invention. As illustrated in FIG. 1, a speech processing apparatus 10 includes a storage 11, an expectation value calculation unit 12, and an acoustic power estimation unit 13. The directions of arrows in the drawing are examples only and do not limit the directions of signals between blocks. Similarly, in the other block diagrams referred to hereinafter, the directions of arrows in the drawing are examples only and do not limit the directions of signals between blocks.

A spectrum $S_{in}(k)$ ($k=0, \ldots, K-1$, where k is a frequency bin and K is the Nyquist frequency) calculated from one block of a digital signal is input to the speech processing apparatus 10. Hereinafter, this spectrum $S_{in}(k)$ will be referred to as an input spectrum or an input signal spectrum. Moreover, the speech processing apparatus 10 outputs the power (acoustic power) $\gamma$ (scalar quantity) of an acoustic component included in the input spectrum.

(Storage 11)

A speech model that models a feature quantity of speech is stored in the storage 11. Specifically, a Gaussian mixture model (GMM) is stored in the storage 11.

In GMM, a feature quantity (in the present example embodiment, an M-dimensional vector (M is a natural number)) extracted from speech data collected in advance is used as learning data. Specifically, GMM is made up of a plurality of Gaussian distributions. Each Gaussian distribution has parameters including a weight, a mean vector, and a variance matrix.

Hereinafter, N is the number of mixtures (the number of Gaussian distributions that form GMM) of the GMM, $w_i$ is the weight of an i-th Gaussian distribution, $\mu_i$ ($\in R^M$, where $R^M$ is an M-dimensional real vector space) is a mean vector, and $\Sigma_i$ ($\in R^{M\times M}$, where $i=0, \ldots, N-1$) (N is a natural number) is a variance matrix. Hereinafter, the parameters of an i-th Gaussian distribution will be collectively referred to as $(w_i, \mu_i, \Sigma_i)$.

The feature quantity of speech data (hereinafter referred to as learning data) used for leaning GMM is a feature quantity called mel-spectrum or mel-ceptrum. However, the feature quantity used in the present example embodiment is not limited to these examples. Moreover, the feature quantity may further include a high-order dynamic component such as a first-order dynamic component, a second-order dynamic component, and the like.

The speech model stored in the storage 11 may be a hidden Markov model (HMM).

(Expectation Value Calculation Unit 12)

The expectation value calculation unit 12 calculates, using the input spectrum $S_{in}(k)$ input to the speech processing apparatus 10 and the GMM stored in the storage 11, an expectation value $\hat{S}_E(k)$ (hereinafter referred to as a spectrum expectation value) of the spectrum of the acoustic component included in the input spectrum $S_{in}(k)$. Here, the hat (ˆ) indicates an estimated value (expectation value). In the present description, the hat symbol is on the right side of a preceding character. However, the hat symbol (ˆ) is disposed above a preceding character.

Specifically, in order to calculate the spectrum expectation value, first, the expectation value calculation unit 12 converts the input spectrum $S_{in}(k)$ to a feature quantity vector $s_{in}$ ($\in R^M$) (hereinafter referred to as an input feature quantity). This input feature quantity is equivalent to the feature quantity of the learning data of the GMM. Moreover, the expectation value calculation unit 12 inversely converts the mean vector $\mu_i$ of the GMM to a logarithmic spectrum $S_{\mu,i}(k)$ ($k=0, \ldots, K-1$) (hereinafter referred to as a mean logarithmic spectrum).

The expectation value calculation unit 12 calculates a spectrum expectation value $\hat{S}_E(k)$ according to Equation (2) using the calculated input feature quantity $s_{in}$, the mean logarithmic spectrum $S_{\mu,i}(k)$, and the parameter $(w_i, \mu_i, \Sigma_i)$ of the GMM.

[Math. 2]

$$\hat{S}_E(k) = \exp\left[\frac{\sum_{i=0}^{N-1} S_{\mu,i}(k) w_i N\left(s_{in}; \mu_i, \sum_i\right)}{\sum_{i=0}^{N-1} w_i N\left(s_{in}; \mu_i, \sum_i\right)}\right] \quad (2)$$

Here, N(x;μ,Σ) can be represented by Equation (3).

[Math. 3]

$$N(x;\mu,\sum)=\frac{1}{(\sqrt{2\pi})^m\sqrt{|\sum|}}\exp\left(-\frac{1}{2}(x-\mu)^T\sum^{-1}(x-\mu)\right) \quad (3)$$

Here, m is the number of dimensions of a feature quantity vector.

The expectation value calculation unit 12 supplies the calculated spectrum expectation value $\hat{S}_E(k)$ to the acoustic power estimation unit 13.

(Acoustic Power Estimation Unit 13)

The acoustic power estimation unit 13 estimates the acoustic power γ of the acoustic component of the input spectrum $S_{in}(k)$ based on the input spectrum $S_{in}(k)$ input to the speech processing apparatus 10 and the spectrum expectation value $\hat{S}_E(k)$ supplied from the expectation value calculation unit 12. This acoustic power γ is the output of the speech processing apparatus 10.

Specifically, the acoustic power estimation unit 13 sets the power of the spectrum expectation value $\hat{S}_E(k)$ controlled such that the square error of the spectrum expectation value $\hat{S}_E(k)$ and the input spectrum $S_{in}(k)$ is minimized as the acoustic power γ. The acoustic power estimation unit 13 estimates the acoustic power γ by calculating the acoustic power γ using Equation (4).

[Math. 4]

$$\gamma=\eta\left(\frac{\sum_{k\in\Omega}S_{in}(k)\hat{S}_E(k)}{\sum_{k\in\Omega}\hat{S}_E(k)^2}\right)\sum_{k=0}^{K-1}\hat{S}_E(k) \quad (4)$$

Alternatively, the acoustic power estimation unit 13 may calculate the acoustic power γ using Equation (5).

[Math. 5]

$$\gamma=\eta\left(\frac{\sum_{k\in\Omega}S_{in}(k)}{\sum_{k\in\Omega}\hat{S}_E(k)}\right)\sum_{k=0}^{K-1}\hat{S}_E(k) \quad (5)$$

In Equations (4) and (5), η is a coefficient that determines the magnification of the acoustic power and an experimentally obtained value may be given. Moreover, Ω indicates a set of frequency bins k to be used for addition. |Ω| indicates the number of elements of the set Ω. The set Ω is derived using Equation (6).

[Math. 6]

$$\Omega=\{k\mid\hat{S}_E(k)\geq\theta\} \quad (6)$$

That is, the set Ω is the set of frequency bins k in which the spectrum expectation value $\hat{S}_E(k)$ has a predetermined value θ or more. Several variations may be employed in calculation of θ, and these variations are represented by Equations (7) to (9).

[Math. 7]

$$\theta=\max_k(\hat{S}_E(k)) \quad (7)$$

[Math. 8]

$$\theta=\min\left[\frac{\alpha}{K}\sum_{k=0}^{K-1}\hat{S}_E(k),\ \max_k(\hat{S}_E(k))\right] \quad (8)$$

[Math. 9]

$$\theta=\min\left[\alpha\left(\sum_{k=0}^{K-1}\hat{S}_E(k)\right)^{\frac{1}{K}},\ \max_k(\hat{S}_E(k))\right] \quad (9)$$

Here, the set Ω when Equation (7) is used is the set of frequency bins k in which the spectrum expectation value $\hat{S}_E(k)$ is maximized. The set Ω when Equation (8) is used is the set of frequency bins that exceeds an addition mean of the spectrum expectation value $\hat{S}_E(k)$. The set Ω when Equation (9) is used is the set of frequency bins that exceeds a geometric mean of the spectrum expectation value $\hat{S}_E(k)$.

Here, α in Equations (8) and (9) is a scalar quantity and is given in advance. The scalar quantity α may be an experimentally derived value. Furthermore, the set Ω may be the top P frequency bins of the spectrum expectation value $\hat{S}_E(k)$. The "top P frequency bins of the spectrum expectation value $\hat{S}_E(k)$" mean P spectrum expectation values arranged in descending order of expectation values.

In Equation (6), the set Ω is calculated by comparison between the spectrum expectation value $\hat{S}_E(k)$ and θ. However, the set Ω may be calculated by comparison between θ and linear coupling of the spectrum expectation value $\hat{S}_E(k)$ and the input spectrum $S_{in}(k)$.

In this manner, the acoustic power estimation unit 13 calculates the acoustic power γ of a frequency component k in which the value of the spectrum expectation value $\hat{S}_E(k)$ or the values of the spectrum expectation value $\hat{S}_E(k)$ and the input spectrum $S_{in}(k)$ is equal to or larger than a predetermined value θ. Due to this, the acoustic power estimation unit 13 calculates the acoustic power γ using the frequency components only having the predetermined value θ or more. Therefore, the speech processing apparatus 10 according to the present example embodiment can estimate the acoustic power γ with higher accuracy.

The acoustic power estimation unit 13 may calculate a speech-likelihood value of an input spectrum. In this case, the acoustic power estimation unit 13 may further include a calculation unit that calculates the speech-likelihood value. Moreover, the acoustic power estimation unit 13 may change an acoustic power estimation method according to the value calculated by the calculation unit.

For example, the acoustic power estimation unit 13 may change the value η in Equation (4) or (5) according to the speech-likelihood. For example, the acoustic power estimation unit 13 may increase the value η when the input spectrum is likely to be speech and may set the value η to 0 when the input spectrum is not likely to be speech. Moreover, the acoustic power estimation unit 13 may change the predetermined value (threshold) θ or the value α in Equations (8) and (9) which are equations that determine the threshold θ according to the speech-likelihood. That is, the acoustic power estimation unit 13 may change the predetermined value θ which is compared with the spectrum expectation value $\hat{S}_E(k)$ or the values of the spectrum expectation value $\hat{S}_E(k)$ and the input spectrum $S_{in}(k)$ based on the speech-likelihood of the input spectrum. For example, the acoustic power estimation unit 13 may set the threshold θ such as to increase the number of elements of Ω when the input spectrum is likely to be speech and may set the threshold θ such as to decrease the number of elements of Ω when the input spectrum is not likely to be speech.

Here, the "speech-likelihood" may be calculated using the parameters and the input spectrum of a speech model and a noise model prepared in advance. For example, when a speech-likelihood index is L, L is calculated using Equation (10).

[Math. 10]

$$L = \frac{\max_l w_l N\left(s_{in}; \mu_l, \sum_l\right)}{\max_j w_j N\left(s_{in}; \mu_j, \sum_j\right)} \tag{10}$$

Here, $(w_l, \mu_l, \Sigma_l)$ represents the parameters of each Gaussian distribution when a speech model prepared in advance is the GMM and $(w_j, \mu_j, \Sigma_j)$ represents the parameters of each Gaussian distribution when a noise model prepared in advance is the GMM. These parameters may be stored in the storage 11. Moreover, $s_{in}$ is a feature quantity vector of the input spectrum.

When the index L indicating the speech-likelihood is large (for example, larger than a predetermined value), it indicates that the input spectrum is likely to be speech. When the index L is small (for example, smaller than another predetermined value), it indicates that the input spectrum is not likely to be speech. Therefore, when the input spectrum is likely to be speech (that is, when the value L is large), the acoustic power estimation unit 13 sets the threshold θ to a smaller value such as to increase the number of elements of Ω. Similarly, when the input spectrum is not likely to be speech (that is, when the value L is small), the acoustic power estimation unit 13 sets the threshold θ to a larger value such as to decrease the number of elements of Ω. In this manner, by setting the value θ, the acoustic power estimation unit 13 can calculate the acoustic power γ with higher accuracy.

The acoustic power estimation unit 13 may derive the acoustic power according to Equation (11) using the index L of the speech-likelihood.

[Math. 11]

$$\gamma = \begin{cases} \gamma_1 & \text{if } (L > \phi_1) \\ \gamma_2 & \text{elseif}(\phi_1 \geq L > \phi_2) \\ 0 & \text{otherwise} \end{cases} \tag{11}$$

Here, $\gamma_1$ and $\gamma_2$ may be calculated based on Equation (4) or (5) under the set Ω and the value η calculated using different θ. Moreover, $\phi_1$ and $\phi_2$ may be values obtained experimentally to be $\phi_1 > \phi_2$.

The values $\gamma_1$ and $\gamma_2$ may be predetermined values (first acoustic power and second acoustic power). Moreover, the acoustic power estimation unit 13 may set the first acoustic power $\gamma_1$ and/or the second acoustic power $\gamma_2$ to be $\gamma_1 > \gamma_2$. In this manner, the acoustic power estimation unit 13 can estimate the acoustic power γ of the input spectrum $S_{in}(k)$ with higher accuracy by setting the acoustic power γ to the second acoustic power $\gamma_2$ which is the smaller value when the index L indicating the speech-likelihood is small.

(Hardware Configuration of Speech Processing Apparatus 10)

Figure 2:
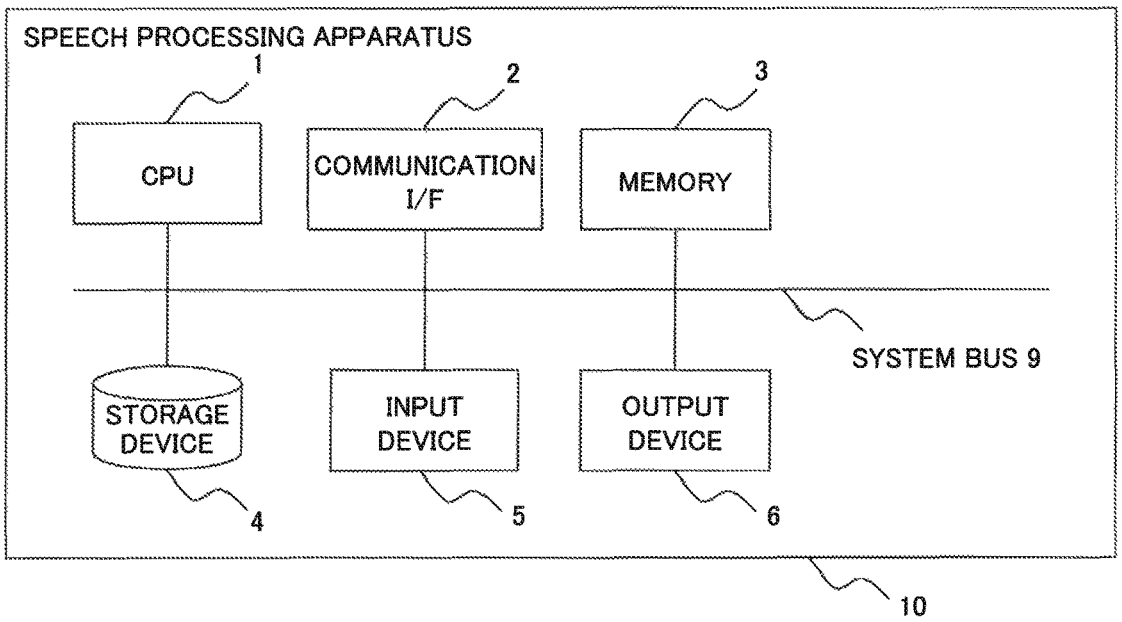
FIG. 2 is a diagram illustrating an example of a hardware configuration of the speech processing apparatus according to the first example embodiment of the present invention.

Next, a hardware configuration of the speech processing apparatus 10 will be described with reference to FIG. 2. FIG. 2 is a diagram illustrating an example of a hardware configuration of the speech processing apparatus 10 according to the present example embodiment. As illustrated in FIG. 2, the speech processing apparatus 10 includes a central processing unit (CPU) 1, a network connection communication interface (communication I/F) 2, a memory 3, a storage device 4 such as a hard disk that stores programs, an input device 5, and an output device 6. These components are connected by a system bus 9.

The CPU 1 operates an operating system to control the speech processing apparatus 10 according to the present example embodiment. Moreover, the CPU 1 reads a program and data from a recording medium attached to a drive device, for example, and writes the same to the memory 3.

The CPU 1 functions as a part of the expectation value calculation unit 12 and the acoustic power estimation unit 13 of the present example embodiment, for example, and executes various processes based on the program written to the memory 3, for example.

The storage device 4 is an optical disc, a flexible disk, a magneto-optical disc, an externally attached hard disk, a semiconductor memory, or the like, for example. Some storage medium of the storage device 4 is a nonvolatile storage device and a program is stored in the nonvolatile storage device. The program may be downloaded from an external computer (not illustrated) connected to a communication network via the communication I/F 2, for example. The storage device 4 functions as the storage 11 of the present example embodiment, for example.

The input device 5 is implemented by a touch sensor or the like, for example, and is used for inputting operations. The output device 6 is implemented by a display, for example, and is used for checking output.

As described above, the speech processing apparatus 10 according to the present example embodiment is implemented by the hardware configuration illustrated in FIG. 2. However, means for implementing the respective units of the speech processing apparatus 10 is not particularly limited.

(Processing of Speech Processing Apparatus 10)

Figure 3:
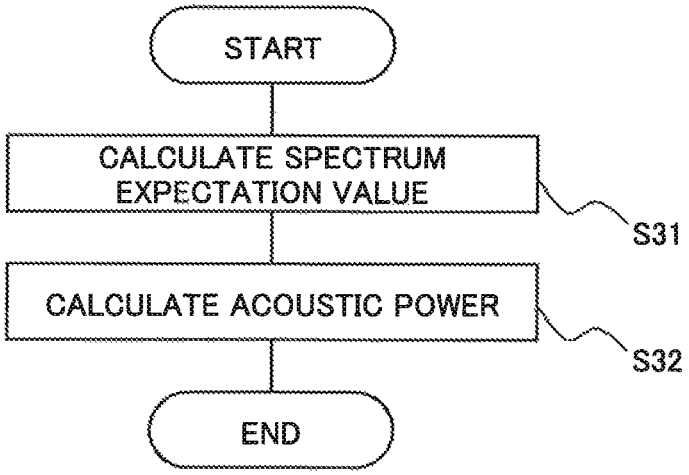
FIG. 3 is a flowchart illustrating an example of the flow of an acoustic power estimation process of the speech processing apparatus according to the first example embodiment of the present invention.

Next, the flow of the processing of the speech processing apparatus 10 will be described with reference to FIG. 3. FIG. 3 is a flowchart illustrating an example of the flow of an acoustic power estimation process of the speech processing apparatus 10 according to the present example embodiment.

As illustrated in FIG. 3, first, the expectation value calculation unit 12 of the speech processing apparatus 10 calculates the spectrum expectation value $\hat{S}_E(k)$ using the input spectrum $S_{in}(k)$ and the parameters of the GMM stored in the storage 11 (step S31).

Subsequently, the acoustic power estimation unit 13 calculates the acoustic power γ using the input spectrum $S_{in}(k)$ and the spectrum expectation value $\hat{S}_E(k)$ calculated by the expectation value calculation unit 12 (step S32) and ends the process.

(Effects)

According to the speech processing apparatus 10 according to the present example embodiment, it is possible to estimate the acoustic power included in the input signal with high accuracy.

This is because the expectation value calculation unit 12 calculates the expectation value (the spectrum expectation value $S^{\wedge}_{E}(k)$) of the spectrum of the acoustic component included in the input spectrum $S_{in}(k)$ using the input spectrum $S_{in}(k)$ and the speech model (GMM) that models the feature quantity of speech. Moreover, the acoustic power estimation unit 13 estimates the acoustic power $\gamma$ of the acoustic component of the input spectrum $S_{in}(k)$ based on the input spectrum $S_{in}(k)$ and the spectrum expectation value $S^{\wedge}_{E}(k)$.

In this manner, the acoustic power $\gamma$ estimated by the acoustic power estimation unit 13 is calculated by referring to the spectrum expectation value $S^{\wedge}_{E}(k)$ calculated from the speech model and the input spectrum $S_{in}(k)$. Therefore, even when the input signal includes noise or the noise is suppressed, it is possible to calculate the acoustic power $\gamma$ with high accuracy. Therefore, the speech processing apparatus 10 according to the present example embodiment can calculate the acoustic power $\gamma$ of the acoustic component included in the input spectrum $S_{in}(k)$ with high accuracy.

The acoustic power estimation unit 13 of the speech processing apparatus 10 according to the present example embodiment sets the power of the spectrum expectation value $S^{\wedge}_{E}(k)$ controlled such that an error between the spectrum expectation value $S^{\wedge}_{E}(k)$ and the input spectrum $S_{in}(k)$ is minimized in a predetermined band where the influence of noise is small as the acoustic power $\gamma$. Due to this, it is possible to control the spectrum expectation value $S^{\wedge}_{E}(k)$ to approach the speech spectrum included in the input spectrum $S_{in}(k)$. Therefore, the speech processing apparatus 10 according to the present example embodiment can estimate the acoustic power included in the input signal with higher accuracy.

<Second Example Embodiment>

Hereinafter, a second example embodiment of the present invention will be described with reference to the drawings. A noise suppression apparatus according to the second example embodiment is a model-based noise suppression apparatus disclosed in Non-Patent Literature 1 and uses the acoustic power calculated by the first example embodiment as a noise suppression gain. For the sake of convenience, components having the same functions as the components included in the drawings described in the first example embodiment will be denoted by the same reference numerals and the description thereof will not be provided.

(Configuration of Noise Suppression Apparatus 20)

Figure 4:
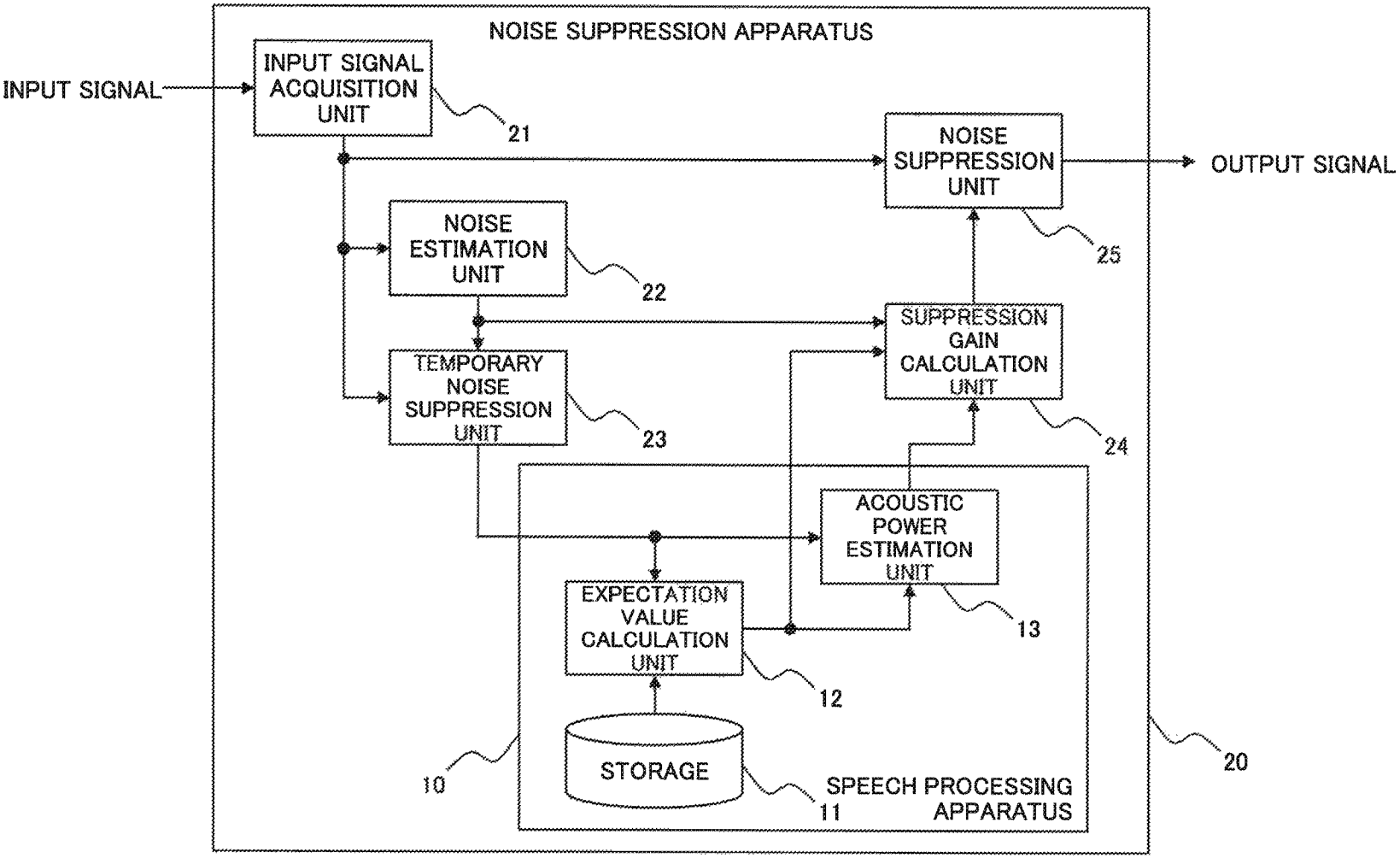
FIG. 4 is a functional block diagram illustrating an example of a functional configuration of a noise suppression apparatus according to a second example embodiment of the present invention.

FIG. 4 is a functional block diagram illustrating an example of a functional configuration of the noise suppression apparatus 20 according to the second example embodiment of the present invention. As illustrated in FIG. 4, the noise suppression apparatus 20 includes the speech processing apparatus 10 described in the first example embodiment, an input signal acquisition unit 21, a noise estimation unit 22, a temporary noise suppression unit 23, a suppression gain calculation unit 24, and a noise suppression unit 25. The noise suppression apparatus 20 receives a digital signal as an input and outputs a digital signal obtained by controlling the acoustic power.

(Input Signal Acquisition Unit 21)

The input signal acquisition unit 21 acquires (receives) the digital signal input to the noise suppression apparatus 20. This digital signal is also referred to as an input signal. The input signal acquisition unit 21 slices the acquired digital signal into respective frames corresponding to predetermined unit periods and converts the same to spectra.

Specifically, the input signal acquisition unit 21 converts a t-th frame x(t) ($\in R^{T}$, where T is the number of samples included in the frame) (t is a natural number; hereinafter t is referred to as a frame period) of the sliced digital signal to a spectrum X(t,k) (k=0, . . . , K−1). Hereinafter, this converted spectrum X(t,k) is referred to as an input signal spectrum.

The input signal acquisition unit 21 supplies the converted input signal spectrum X(t,k) to the noise estimation unit 22, the temporary noise suppression unit 23, and the noise suppression unit 25.

Here, the number of samples T included in a frame will be described. For example, when the digital signal is a 16-bit signal having a sampling frequency of 8000 Hz converted according to the linear pulse code modulation (linear PCM), the digital signal is values corresponding to 8000 points per second. In this case, when one frame length is 25 milliseconds, one frame includes values corresponding to 200 points. Therefore, T=200.

Examples of the digital signal acquired by the input signal acquisition unit 21 include (1) a digital signal supplied from a microphone or the like via an A/D converter, (2) a digital signal read by a hard disk, (3) a digital signal obtained from a communication packet, and the like. However, in the present example embodiment, the digital signal is not limited to these digital signals. Moreover, the digital signal may be a speech signal recorded under a noisy environment and a speech signal which has been subjected to a noise suppression process.

(Noise Estimation Unit 22)

The noise estimation unit 22 is means for estimating estimated noise from the input signal spectrum. The noise estimation unit 22 receives the input signal spectrum X(t,k) from the input signal acquisition unit 21. The noise estimation unit 22 estimates (calculates) a spectrum $N^{\wedge}(t,k)$ (where k=0, . . . , K−1) of a noise component included in the received input signal spectrum X(t,k). The spectrum $N^{\wedge}(t,k)$ of the estimated noise component (estimated noise) will be referred to as an estimated noise spectrum. The noise estimation unit 22 supplies the estimated noise spectrum $N^{\wedge}(t,k)$ to the temporary noise suppression unit 23 and the suppression gain calculation unit 24.

In the present example embodiment, the noise estimation unit 22 calculates the estimated noise using the existing weighted noise estimation (WiNE). However, calculation of the estimated noise in the noise estimation unit 22 is not limited to this. The noise estimation unit 22 may calculate the estimated noise using a desired method.

In this way, the noise estimation unit 22 can estimate noise included in the input signal. In the present example embodiment, the estimated noise is also referred to as temporary noise.

(Temporary Noise Suppression Unit 23)

The temporary noise suppression unit 23 is means for generating a noise suppression signal in which temporary noise is suppressed from the input signal using the input signal spectrum and the estimated noise spectrum. Specifically, the temporary noise suppression unit 23 receives the input signal spectrum X(t,k) from the input signal acquisition unit 21. Moreover, the temporary noise suppression unit 23 receives the estimated noise spectrum $N^{\wedge}(t,k)$ from the noise estimation unit 22. The temporary noise suppression unit 23 removes the estimated noise spectrum $N^{\wedge}(t,k)$ from the input signal spectrum X(t,k) and calculates a temporary noise suppression spectrum $S^{\wedge}(t,k)$ (where k=0, . . . , K−1). A signal including this temporary noise suppression spectrum $S^{\wedge}(t,k)$ is referred to as a noise suppression signal. This noise suppression signal is referred to as a temporarily estimated speech since the noise suppression signal is a signal obtained by suppressing temporary noise.

The temporary noise suppression unit 23 supplies the calculated temporary noise suppression spectrum $\hat{S}(t,k)$ to the speech processing apparatus 10.

In the present example embodiment, the temporary noise suppression unit 23 calculates the temporary noise suppression spectrum $\hat{S}(t,k)$ using an existing technique (for example, spectral subtraction (SS), Wiener filter (WF), and the like). However, the present example embodiment is not limited to this. The temporary noise suppression unit 23 may calculate the spectrum of the temporarily estimated speech using a desired method. The noise suppression apparatus 20 may omit the processing of the temporary noise suppression unit 23 when a small amount of noise is included in the input signal or the input signal has already been subjected to noise suppression. In this case, the temporary noise suppression spectrum $\hat{S}(t,k)$ is the input signal spectrum X(t,k).

In this manner, the temporary noise suppression unit 23 supplies the temporary noise suppression spectrum $\hat{S}(t,k)$ obtained by suppressing the temporary noise whereby the speech processing apparatus 10 can use the temporary noise suppression spectrum $\hat{S}(t,k)$ obtained by suppressing the temporary noise as the input spectrum $S_{in}(k)$. In this way, the speech processing apparatus 10 can estimate the acoustic power with higher accuracy.

(Speech Processing Apparatus 10)

The speech processing apparatus 10 calculates an acoustic power γ(t) from the temporary noise suppression spectrum $\hat{S}(t,k)$ supplied by the temporary noise suppression unit 23. The speech processing apparatus 10 supplies the acoustic power γ(t) to the suppression gain calculation unit 24. Moreover, the speech processing apparatus 10 also supplies the spectrum expectation value $\hat{S}_E(t,k)$ calculated in the course of calculation of the acoustic power γ(t) to the suppression gain calculation unit 24. The spectrum expectation value $\hat{S}_E(t,k)$ is calculated by the expectation value calculation unit 12 as described in the first example embodiment.

Since the speech processing apparatus 10 has been described in the first example embodiment, the specific description thereof will not be provided. However, in the present example embodiment, the input spectrum $S_{in}(k)$, the spectrum expectation value $\hat{S}_E(k)$, and the acoustic power γ are replaced with the temporary noise suppression spectrum $\hat{S}(t,k)$, the spectrum expectation value $\hat{S}_E(t,k)$, and the acoustic power γ(t).

(Suppression Gain Calculation Unit 24)

The suppression gain calculation unit 24 is means for calculating a suppression gain using the spectrum expectation value $\hat{S}_E(t,k)$, the acoustic power γ(t), and the estimated noise spectrum $\hat{N}(t,k)$.

Specifically, the suppression gain calculation unit 24 receives the estimated noise spectrum $\hat{N}(t,k)$ from the noise estimation unit 22. Moreover, the suppression gain calculation unit 24 receives the acoustic power γ(t) and the spectrum expectation value $\hat{S}_E(t,k)$ from the speech processing apparatus 10. The suppression gain calculation unit 24 calculates a suppression gain W(t,k) (where k=0, . . . , K−1) according to Equation (12) using the received estimated noise spectrum $\hat{N}(t,k)$, the acoustic power γ(t), and the spectrum expectation value $\hat{S}_E(t,k)$.

[Math. 12]

$$W(t,k) = \frac{\gamma(t)\dfrac{\hat{S}_E(t,k)}{\sum_{k=0}^{K-1}\hat{S}_E(t,k)}}{\gamma(t)\dfrac{\hat{S}_E(t,k)}{\sum_{k=0}^{K-1}\hat{S}_E(t,k)} + \hat{N}(t,k)} \tag{12}$$

As illustrated in Equation (12), the nominator on the right side of Equation (12) is the product of the acoustic power γ(t) and the spectrum expectation value obtained by dividing the spectrum expectation value $\hat{S}_E(t,k)$ by the sum at k of the spectrum expectation value $\hat{S}_E(t,k)$. Moreover, the denominator on the right side of Equation (12) is the sum of the product and the estimated noise spectrum $\hat{N}(t,k)$. That is, the suppression gain calculation unit 24 calculates the ratio of (a) the product of the spectrum expectation value and the acoustic power γ(t) to (b) the sum of the product and the estimated noise spectrum $\hat{N}(t,k)$ as the suppression gain W(t,k).

In this manner, when calculating the suppression gain W(t,k), the suppression gain calculation unit 24 uses the acoustic power γ(t) and the spectrum expectation value $\hat{S}_E(t,k)$ calculated by the speech processing apparatus 10. This acoustic power γ(t) is calculated by referring to the speech model and the spectrum expectation value $\hat{S}_E(t,k)$ calculated from the temporary noise suppression spectrum $\hat{S}(t,k)$. Therefore, the suppression gain calculation unit 24 can calculate the suppression gain W(t,k) using the acoustic power γ(t) having high estimation accuracy.

The suppression gain calculation unit 24 supplies the calculated suppression gain W(t,k) to the noise suppression unit 25.

(Noise Suppression Unit 25)

The noise suppression unit 25 is means for suppressing the noise in the input signal using the suppression gain W(t,k) and the input signal spectrum X(t,k). Specifically, the noise suppression unit 25 receives the input signal spectrum X(t,k) from the input signal acquisition unit 21. Moreover, the noise suppression unit 25 receives the suppression gain W(t,k) from the suppression gain calculation unit 24. The noise suppression unit 25 calculates a noise suppression spectrum Y(t,k) (where k=0, . . . , K−1) using the input signal spectrum X(t,k) and the suppression gain W(t,k). The noise suppression unit 25 calculates the noise suppression spectrum Y(t,k) using Equation (13).

$$Y(t,k)=W(t,k)X(t,k) \tag{13}$$

The noise suppression spectrum Y(t,k) is a spectrum in which noise included in the input signal spectrum X(t,k) is suppressed from the input signal spectrum X(t,k).

The noise suppression unit 25 converts the calculated noise suppression spectrum Y(t,k) to a feature quantity vector and outputs the same to a speech recognition device as a feature quantity vector of the estimated speech. When the feature quantity vector is output to a speech reproduction apparatus such as a speaker, the noise suppression unit 25 performs inverse-Fourier transform on the spectrum of the estimated speech obtained from the converted feature quantity vector to obtain a time-domain signal and outputs the signal (digital signal). Hereinafter, the feature quantity vector or the digital signal output by the noise suppression unit 25 is referred to as an output signal.

Since the hardware configuration of the noise suppression apparatus 20 according to the present example embodiment is the same as the hardware configuration of the speech processing apparatus 10 of the first example embodiment illustrated in FIG. 2, the description thereof will not be provided.

(Processing of Noise Suppression Apparatus 20)

Figure 5:
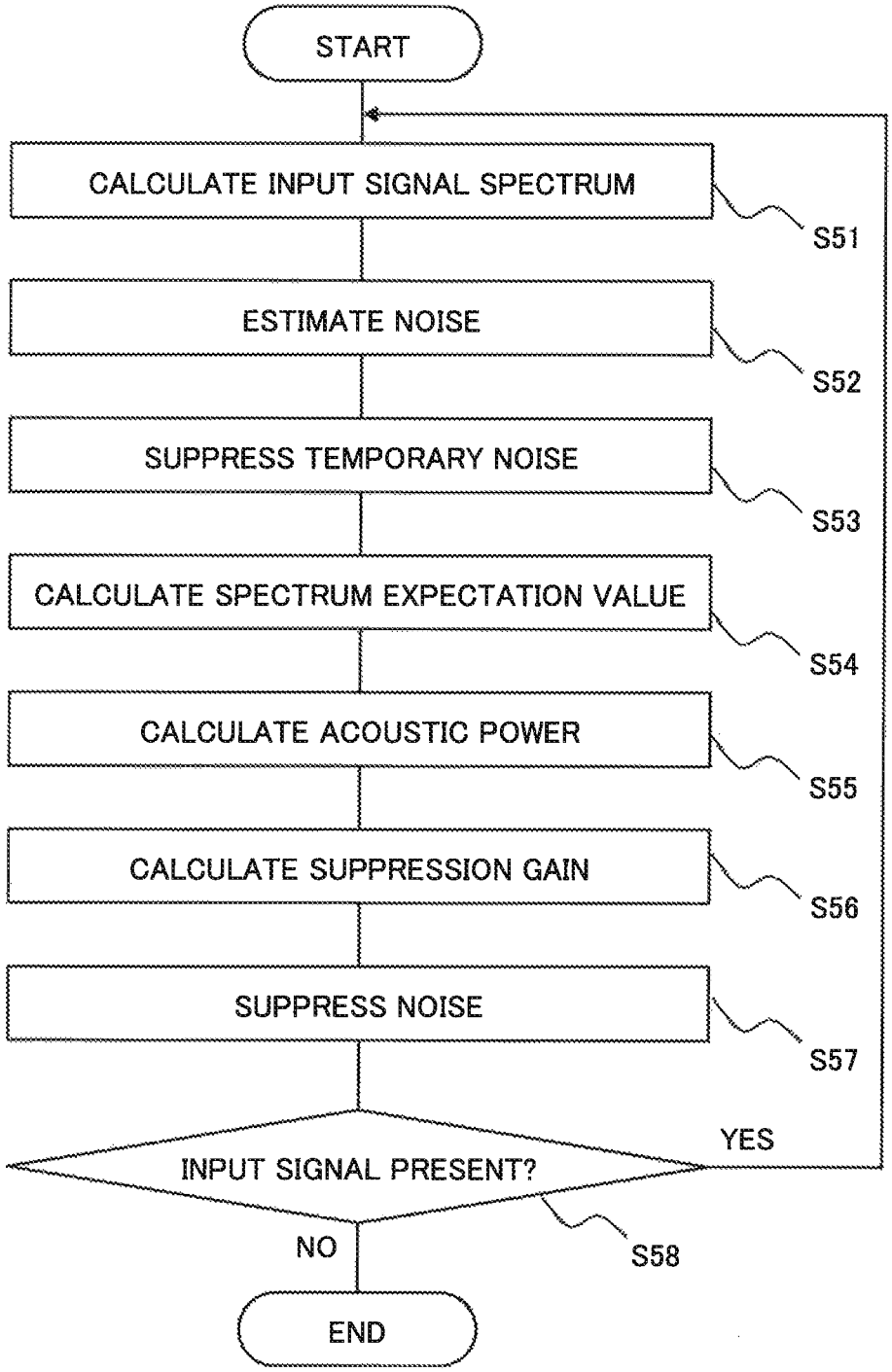
FIG. 5 is a flowchart illustrating an example of the flow of a noise suppression process of the noise suppression apparatus according to the second example embodiment of the present invention.

Next, the flow of processing of the noise suppression apparatus 20 will be described with reference to FIG. 5. FIG. 5 is a flowchart illustrating an example of the flow (noise suppression process) of deriving the noise suppression spectrum Y(t,k) by the noise suppression apparatus 20 according to the present example embodiment.

As illustrated in FIG. 5, first, the input signal acquisition unit 21 of the noise suppression apparatus 20 calculates the input signal spectrum X(t,k) (step S51).

Subsequently, the noise estimation unit 22 estimates noise included in the input signal. That is, the noise estimation unit 22 estimates the estimated noise spectrum N^(t,k) from the input signal spectrum X(t,k) (step S52).

The temporary noise suppression unit 23 suppresses temporary noise in the input signal spectrum X(t,k). That is, the temporary noise suppression unit 23 removes the estimated noise spectrum N^(t,k) from the input signal spectrum X(t,k) to calculate the temporary noise suppression spectrum S^(t,k) (step S53). As described above, this step may be omitted. In this case, the temporary noise suppression spectrum S^(t,k) is the input signal spectrum X(t,k).

Subsequently, the speech processing apparatus 10 calculates the spectrum expectation value $\hat{S}_E(t,k)$ using the temporary noise suppression spectrum S^(t,k) as an input (step S54). The speech processing apparatus 10 calculates the acoustic power γ(t) (step S55). Steps S54 and S55 are the same processes as steps S31 and S32 described in the first example embodiment, respectively.

Subsequently, the suppression gain calculation unit 24 calculates the suppression gain W(t,k) based on the estimated noise spectrum N^(t,k), the spectrum expectation value $\hat{S}_E(t,k)$, and the acoustic power γ(t) (step S56).

The noise suppression unit 25 suppresses noise in the input signal. That is, the noise suppression unit 25 calculates the noise suppression spectrum Y(t,k) by multiplying the suppression gain W(t,k) by the input signal spectrum X(t,k) (step S57).

Lastly, the input signal acquisition unit 21 of the noise suppression apparatus 20 checks whether there is a remaining digital signal to be processed (step S58). When there is a remaining digital signal to be processed (step S58: YES), the process returns to step S51. In other case (step S58: NO), the process ends.

(Effects)

The speech processing apparatus 10 of the noise suppression apparatus 20 according to the present example embodiment can estimate the acoustic power included in the input signal with higher accuracy similarly to the speech processing apparatus 10 according to the first example embodiment.

The noise suppression apparatus 20 according to the present example embodiment can suppress noise with higher accuracy since the noise included in the input signal is suppressed using the acoustic power having high accuracy.

<Third Example Embodiment>

Next, a third example embodiment of the present invention will be described. In the present example embodiment, a minimal configuration for solving the problems of the present invention will be described.

In the first and second example embodiments, although a configuration in which the storage 11 is included in the speech processing apparatus 10 has been described, the storage 11 may be implemented as an apparatus independent from the speech processing apparatus 10. This configuration will be described with reference to FIG. 6. For the sake of convenience, components having the same functions as the components included in the drawings described in the respective example embodiments will be denoted by the same reference numerals and the description thereof will not be provided.

Since the hardware configuration of the speech processing apparatus 30 according to the present example embodiment is the same as the hardware configuration of the speech processing apparatus 10 according to the first example embodiment illustrated in FIG. 2, the description thereof will not be provided.

Figure 6:
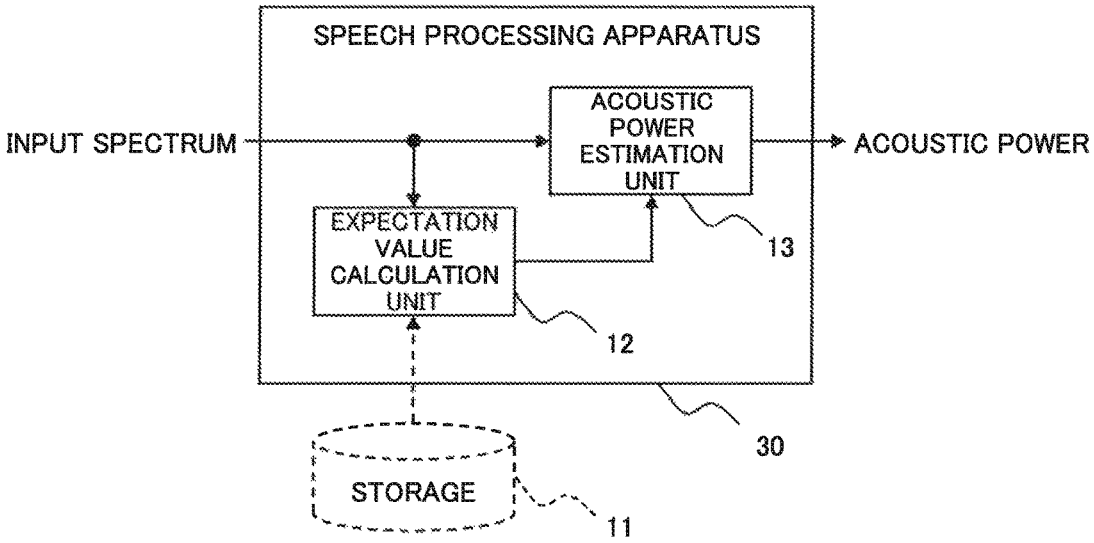
FIG. 6 is a functional block diagram illustrating an example of a functional configuration of a speech processing apparatus according to a third example embodiment of the present invention.

FIG. 6 is a functional block diagram illustrating an example of a functional configuration of the speech processing apparatus 30 according to the present example embodiment. As illustrated in FIG. 6, the speech processing apparatus 30 includes an expectation value calculation unit 12 and an acoustic power estimation unit 13.

The expectation value calculation unit 12 calculates a spectrum expectation value which is an expectation value of the spectrum of an acoustic component included in an input signal spectrum using the input signal spectrum and a speech model that models a feature quantity of speech. This speech model is stored in the storage 11 described in the first and second example embodiments.

The expectation value calculation unit 12 supplies the calculated spectrum expectation value to the acoustic power estimation unit 13.

The acoustic power estimation unit 13 estimates the acoustic power of the acoustic component of the input signal spectrum based on the input signal spectrum and the spectrum expectation value supplied from the expectation value calculation unit 12.

In this manner, according to the speech processing apparatus 30 according to the present example embodiment, the acoustic power estimation unit 13 estimates the acoustic power of the acoustic component of the input signal using the input signal spectrum and the spectrum expectation value calculated using the speech model.

Therefore, the speech processing apparatus 30 according to the present example embodiment can estimate the acoustic power included in the input signal with higher accuracy.

The above-described example embodiments are preferred example embodiments according to the present invention, and the scope of the present invention is not limited to the above-described example embodiments only. The above-described example embodiments may be modified or substituted by those skilled in the art without departing from the gist of the present invention, and a variety of forms in which a change is applied to the example embodiment can be constructed.

For example, the operations of the above-described example embodiments may be executed by hardware or software or both.

When the processes are executed by software, a program may be installed on a general-purpose computer that can execute the processes and the program may be executed by the computer, for example. Moreover, the program may be recorded on a recording medium such as a hard disk, for example.

A portion of or the whole of the example embodiment described above can be described in the following Supplementary Notes, but not limited thereto.

(Supplementary Note 1) A speech processing apparatus including: expectation value calculation means for calculating, using an input signal spectrum and a speech model that models a feature quantity of speech, a spectrum expectation value which is an expectation value of a spectrum of an acoustic component included in the input signal spectrum; and acoustic power estimation means for estimating an acoustic power of the acoustic component of the input signal spectrum based on the input signal spectrum and the spectrum expectation value.

(Supplementary Note 2) The speech processing apparatus according to Supplementary Note 1, wherein the acoustic power estimation means estimates the power of the spectrum expectation value controlled to minimize an error between the spectrum expectation value and the input signal spectrum as the acoustic power.

(Supplementary Note 3) The speech processing apparatus according to Supplementary Note 1 or 2, wherein the acoustic power estimation means calculates the acoustic power of a frequency component for which the spectrum expectation value or the spectrum expectation value and a value of the input signal spectrum is a predetermined value or more.

(Supplementary Note 4) The speech processing apparatus according to Supplementary Note 3, wherein the acoustic power estimation means changes the predetermined value to be compared with the spectrum expectation value or the spectrum expectation value and the value of the input signal spectrum based on a speech-likelihood of the input signal spectrum.

(Supplementary Note 5) The speech processing apparatus according to Supplementary Note 4, wherein the acoustic power estimation means sets the predetermined value to a smaller value when an index indicating the speech-likelihood is large and sets the predetermined value to a larger value when the index is small.

(Supplementary Note 6) The speech processing apparatus according to Supplementary Note 4 or 5, wherein the acoustic power estimation means estimates the acoustic power as the power of a predetermined acoustic component having a smaller value when the index indicating the speech-likelihood is small.

(Supplementary Note 7)

The speech processing apparatus according to any one of Supplementary Notes 1 to 6, further including storage means for storing the speech model.

(Supplementary Note 8) A noise suppression apparatus including: noise estimation means for calculating estimated noise from an input signal; a speech processing apparatus that estimates an expectation value of a spectrum of an acoustic component included in a spectrum of the input signal and an acoustic power of the acoustic component from the spectrum of the input signal; suppression gain calculation means for calculating a suppression gain using the expectation value of the spectrum of the acoustic component, the acoustic power, and the spectrum of the estimated noise; and noise suppression means for suppressing noise in the input signal using the suppression gain and the spectrum of the input signal, wherein the speech processing apparatus includes: expectation value calculation means for calculating, using the spectrum of the input signal and a speech model that models a feature quantity of speech, an expectation value of the spectrum of the acoustic component; and acoustic power estimation means for estimating the acoustic power based on the spectrum of the input signal and the expectation value of the spectrum of the acoustic component.

(Supplementary Note 9) The noise suppression apparatus according to Supplementary Note 8, wherein the acoustic power estimation means estimates the power of an expectation value of the spectrum of the acoustic component controlled to minimize an error between the expectation value of the spectrum of the acoustic component and the spectrum of the input signal as the acoustic power.

(Supplementary Note 10) The noise suppression apparatus according to Supplementary Note 8 or 9, wherein the acoustic power estimation means calculates the acoustic power of a frequency component for which the expectation value of the spectrum of the acoustic component or the expectation value of the spectrum of the acoustic component and the value of the spectrum of the input signal is a predetermined value or more.

(Supplementary Note 11) The noise suppression apparatus according to Supplementary Note 10, wherein the acoustic power estimation means changes the predetermined value to be compared with the expectation value of the spectrum of the acoustic component or the expectation value of the spectrum of the acoustic component and the value of the spectrum of the input signal based on a speech-likelihood of the spectrum of the input signal.

(Supplementary Note 12) The noise suppression apparatus according to Supplementary Note 11, wherein the acoustic power estimation means sets the predetermined value to a smaller value when an index indicating the speech-likelihood is large and sets the predetermined value to a larger value when the index is small.

(Supplementary Note 13) The noise suppression apparatus according to Supplementary Note 11 or 12, wherein the acoustic power estimation means estimates the acoustic power as the power of a predetermined acoustic component having a smaller value when the index indicating the speech-likelihood is small.

(Supplementary Note 14) The speech processing apparatus according to any one of Supplementary Notes 8 to 13, further including storage means for storing the speech model.

(Supplementary Note 15) A noise suppression apparatus including: noise estimation means for calculating estimated noise from an input signal; the speech processing apparatus according to any one of Supplementary Notes 1 to 7; suppression gain calculation means for calculating a suppression gain using an expectation value of the spectrum of an acoustic component included in the spectrum of the input signal, an acoustic power of the acoustic component, and the spectrum of the estimated noise; and noise suppression means for suppressing noise in the input signal using the suppression gain and the spectrum of the input signal.

(Supplementary Note 16) The noise suppression apparatus according to any one of Supplementary Notes 8 to 15, further including temporary noise suppression means for generating a temporary noise suppression signal in which temporary noise is suppressed from the input signal using the input signal and the estimated noise, wherein the speech processing apparatus estimates the expectation value of the spectrum of the acoustic component and the acoustic power using the spectrum of the temporary noise suppression signal as the spectrum of the input signal.

(Supplementary Note 17) The noise suppression apparatus according to any one of Supplementary Notes 8 to 16, wherein the suppression gain calculation means calculates a ratio of a product between the acoustic power and the expectation value of the spectrum of the acoustic component to a sum of the product and the estimated noise as the suppression gain.

(Supplementary Note 18) A speech processing method including: calculating a spectrum expectation value which is an expectation value of a spectrum of an acoustic component included in an input signal spectrum using the input signal spectrum and a speech model that models a feature quantity of speech; and estimating an acoustic power of the acoustic component of the input signal spectrum based on the input signal spectrum and the spectrum expectation value.

(Supplementary Note 19) A noise suppression method including: calculating estimated noise from an input signal; calculating an expectation value of a spectrum of an acoustic component included in a spectrum of the input signal using the spectrum of the input signal and a speech model that models a feature quantity of speech; estimating an acoustic power of the acoustic component based on the spectrum of the input signal and the expectation value of the spectrum of the acoustic component; calculating a suppression gain using the expectation value of the spectrum of the acoustic component, the acoustic power, and the spectrum of the estimated noise; and suppressing noise in the input signal using the suppression gain and the spectrum of the input signal.

(Supplementary Note 20) A program for causing a computer to execute processes of: calculating a spectrum expectation value which is an expectation value of a spectrum of an acoustic component included in an input signal spectrum using the input signal spectrum and a speech model that models a feature quantity of speech; and estimating an acoustic power of the acoustic component of the input signal spectrum based on the input signal spectrum and the spectrum expectation value.

(Supplementary Note 21) A program for causing a computer to execute processes of: calculating estimated noise from an input signal; calculating an expectation value of a spectrum of an acoustic component included in a spectrum of the input signal using the spectrum of the input signal and a speech model that models a feature quantity of speech; estimating an acoustic power of the acoustic component based on the spectrum of the input signal and the expectation value of the spectrum of the acoustic component; calculating a suppression gain using the expectation value of the spectrum of the acoustic component, the acoustic power, and the spectrum of the estimated noise; and suppressing noise in the input signal using the suppression gain and the spectrum of the input signal.

(Supplementary Note 22) A computer-readable recording medium recording the program according to Supplementary Note 20 or 21.

This application claims the priority based on Japanese Patent Application No. 2014-249982 filed on Dec. 10, 2014, the entire disclosure of which is incorporated herein by reference.

REFERENCE SIGNS LIST

10 Speech processing apparatus
11 Storage
12 Expectation value calculation unit
13 Acoustic power estimation unit
20 Noise suppression apparatus
21 Input signal acquisition unit
22 Noise estimation unit
23 Temporary noise suppression unit
24 Suppression gain calculation unit
25 Noise suppression unit
30 Speech processing apparatus
1 CPU
2 Communication I/F
3 Memory
4 Storage device
5 Input device
6 Output device
9 System bus

What is claimed is:

1. A speech processing apparatus comprising:
a memory configured to store one or more programs;
a processor configured to execute the one or more programs stored in the memory to:
receive an input signal spectrum and a speech model that models a feature quantity of speech;
convert the input signal spectrum into an input feature quantity vector;
inversely convert a mean vector of the speech model to a mean logarithmic spectrum;
calculate a spectrum expectation value based on the input feature quantity vector and the mean logarithmic spectrum, the spectrum expectation value being an expectation value of a spectrum of an acoustic component included in the input signal spectrum;
determine a set of frequency bins, in which, the spectrum expectation value is equal to or greater than a predetermined value or a linear coupling of the spectrum expectation value and a value of the input signal spectrum is equal to or greater than the predetermined value; and
determine an acoustic power of the acoustic component of the input signal spectrum based on the input signal spectrum and the spectrum expectation value of the determined set of frequency bins,
wherein the predetermined value is changed based on a speech-likelihood of the input signal spectrum, and
wherein the speech-likelihood is determined based on the feature quantity vector of the input signal spectrum, one or more parameters of the speech model and one or more parameters of a noise model.

2. The speech processing apparatus according to claim 1, wherein the acoustic power of the acoustic component of the input signal spectrum determined based on minimizing an error between the spectrum expectation value and the input signal spectrum.

3. The speech processing apparatus according to claim 1, wherein the processor is further configured to execute the one or more programs stored in the memory to set the predetermined value to a smaller value when an index indicating the speech-likelihood is large and sets the predetermined value to a larger value when the index is small.

4. The speech processing apparatus according to claim 1, wherein the processor is further configured to execute the one or more programs stored in the memory to determine the acoustic power as the power of a predetermined acoustic component having a smaller value when the index indicating the speech-likelihood is small.

5. A speech processing method comprising:
receiving an input signal spectrum and a speech model that models a feature quantity of speech;
converting the input signal spectrum into an input feature quantity vector;
inversely converting a mean vector of the speech model to a mean logarithmic spectrum;
calculating a spectrum expectation value based on the input feature quantity vector and the mean logarithmic spectrum, the spectrum expectation value being an expectation value of a spectrum of an acoustic component included in an input signal spectrum using the input signal spectrum and a speech model that models a feature quantity of speech;

determining a set of frequency bins, in which, the spectrum expectation value is equal to or greater than a predetermined value or a linear coupling of the spectrum expectation value and a value of the input signal spectrum is equal to or greater than the predetermined value; and determining an acoustic power of the acoustic component of the input signal spectrum based on the input signal spectrum and the spectrum expectation value of the determined set of frequency bins, wherein the predetermined value is changed based on a speech-likelihood of the input signal spectrum, and wherein the speech-likelihood is determined based on the feature quantity vector of the input signal spectrum, one or more parameters of the speech model and one or more parameters of a noise model.

6. A computer-readable non-transitory recording medium storing a program that causes a computer to execute processes of:

receiving an input signal spectrum and a speech model that models a feature quantity of speech;

converting the input signal spectrum into an input feature quantity vector;

inversely converting a mean vector of the speech model to a mean logarithmic spectrum;

calculating a spectrum expectation value based on the input feature quantity vector and the mean logarithmic spectrum, the spectrum expectation value being an expectation value of a spectrum of an acoustic component included in an input signal spectrum using the input signal spectrum and a speech model that models a feature quantity of speech;

determining a set of frequency bins, in which, the spectrum expectation value is equal to or greater than a predetermined value or a linear coupling of the spectrum expectation value and a value of the input signal spectrum is equal to or greater than the predetermined value; and determining an acoustic power of the acoustic component of the input signal spectrum based on the input signal spectrum and the spectrum expectation value of the determined set of frequency bins, wherein the predetermined value is changed based on a speech-likelihood of the input signal spectrum, and wherein the speech-likelihood is determined based on the feature quantity vector of the input signal spectrum, one or more parameters of the speech model and one or more parameters of a noise model.

* * * * *